US008044565B2

(12) United States Patent
Walker, Jr. et al.

(10) Patent No.: US 8,044,565 B2
(45) Date of Patent: Oct. 25, 2011

(54) COMPOSITE CERAMIC ELECTRODE AND IGNITION DEVICE THEREWITH

(75) Inventors: William J. Walker, Jr., Toledo, OH (US); James D. Lykowski, Temperance, MI (US)

(73) Assignee: Federal-Mogul Ingnition Company, Southfield, MI (US)

( * ) Notice: Subject to any disclaimer, the term of this patent is extended or adjusted under 35 U.S.C. 154(b) by 213 days.

(21) Appl. No.: 12/201,590

(22) Filed: Aug. 29, 2008

(65) Prior Publication Data

US 2010/0052499 A1 Mar. 4, 2010

(51) Int. Cl.
*H01J 1/00* (2006.01)
*H01T 13/20* (2006.01)

(52) U.S. Cl. ..... 313/326; 313/141; 313/352

(58) Field of Classification Search ..... None
See application file for complete search history.

(56) References Cited

U.S. PATENT DOCUMENTS 3,988,646 A * 10/1976 Atkins et al. ..... 361/263
4,400,643 A * 8/1983 Nishio et al. ..... 313/11.5
4,659,960 A * 4/1987 Toya et al. ..... 313/141
5,189,333 A * 2/1993 Kagawa et al. ..... 313/140
6,160,342 A 12/2000 Nishikawa
7,388,323 B2 * 6/2008 Shibata et al. ..... 313/143
7,768,184 B2 * 8/2010 Hanashi et al. ..... 313/143
2007/0080618 A1 4/2007 Torii et al.
2008/0143229 A1 6/2008 Walker

OTHER PUBLICATIONS

International Search Report for PCT/US2009/054154 dated Mar. 31, 2010, 2 pages.

* cited by examiner

*Primary Examiner* — Ashok Patel
(74) *Attorney, Agent, or Firm* — Reising Ethington P.C.

(57) ABSTRACT

A spark plug, center electrode and method of construction is provided. The spark plug has a generally annular ceramic insulator and a conductive shell surrounding at least a portion of the ceramic insulator. A ground electrode is operatively attached to the shell, with the ground electrode having a ground electrode sparking surface. A center electrode has an elongate body with a center electrode sparking surface. The center electrode sparking surface and the ground electrode sparking surface provide a spark gap. The center electrode body is constructed of a composite material including at least one ceramic material.

11 Claims, 4 Drawing Sheets

COMPOSITE CERAMIC ELECTRODE AND IGNITION DEVICE THEREWITH

BACKGROUND OF THE INVENTION

1. Field of the Invention

The invention relates generally to ignition devices for internal combustion engines, and more particularly to electrodes therefor.

2. Related Art

A spark plug is a spark ignition device that extends into the combustion chamber of an internal combustion engine and produces a spark to ignite a mixture of air and fuel. Spark plugs typically have an outer ceramic insulator, which is fabricated and fired separately from other components of the spark plug, a center electrode extending partially through the insulator to a firing tip, and a ground electrode extending from an outer metal shell. A separate resistor component is commonly coupled to an end of the electrode within the insulator opposite the firing end of the electrode. The resistor acts to suppress radio frequency (RF) electromagnetic radiation, which if left unchecked, can affect the transmission of other electrical signals, including inferring with radio signals. Typically, the closer the resistor is located to the firing gap between the spaced center and ground electrode firing ends the better, as this is where the spark is produced, thus being a primary location for the generation of RF electromagnetic radiation.

Recent advancements in engine technology are resulting in higher engine operating temperatures to achieve improved engine efficiency and performance. These higher operating temperatures have an adverse affect on the spark plugs by diminishing their useful life. In particular, the higher temperatures are pushing the spark plug electrodes to the very limits of their material capabilities, and in some cases beyond the limits, thereby resulting in failure of the electrode. Presently, Ni-based alloys, including nickel-chromium-iron alloys specified under UNS N06600, such as those sold under the trade names Inconel 600®, Nicrofer 7615®, and Ferrochronin 600®, are in wide use as spark plug electrode materials. These electrodes are typically expected to last up to about 30,000 miles in service, and thereafter, generally need to be replaced.

As is well known, the resistance to high temperature oxidation of these Ni-based nickel-chromium-iron alloys decreases as their operating temperature increases. Since combustion environments are highly oxidizing, corrosive wear including deformation and fracture caused by high temperature oxidation and sulfidation can result and is particularly exacerbated at the highest operating temperatures. At the upper limits of operating temperature (e.g., 1400° F. or higher), tensile, creep rupture and fatigue strength also have been observed to decrease significantly which can result in deformation, cracking and fracture of the electrodes. Depending on the electrode design, specific operating conditions and other factors, these high temperature phenomena may contribute individually and collectively to undesirable growth of the spark plug gap, which increases the voltage required to cause sparking and diminishes performance of the ignition device and associated engine. In extreme cases, failure of the electrode, ignition device and associated engine can result from electrode deformation and fracture resulting from these high temperature phenomena.

Some known attempts to combat failure of electrodes from exposure to the increasing temperatures in high performance engines include fabricating the electrodes from precious metals, such as platinum or iridium. Although the life in services of these electrodes can increase the useful life of the electrode, generally up to about 80,000-100,000 miles, they still typically need to be replaced within the lifetime of the vehicle. Further, these electrodes can be very costly to construct.

Accordingly, there is a need for spark plugs that have electrodes exhibiting an increased useful life in high temperature engine environments; have resistance to high temperature oxidation, sulfidation and related corrosive and erosive wear mechanisms; suppress RF electromagnetic radiation; have sufficient high temperature tensile, creep rupture and fatigue strength; resist cracking and fracture sufficient for use in current and future high temperature/high performance spark ignition devices, and are economical in manufacture.

SUMMARY OF THE INVENTION

A center electrode for a spark ignition device includes a center electrode having an elongate body having a width and a length extending along a longitudinal axis. The body is constructed of a composite material including at least one ceramic material.

According to another aspect of the invention, a spark plug is provided, wherein the spark plug has a generally annular ceramic insulator and a conductive shell surrounding at least a portion of the ceramic insulator. A ground electrode is operatively attached to the shell, with the ground electrode having a ground electrode sparking surface. A center electrode has an elongate body extending along a longitudinal axis to a center electrode sparking surface. The center electrode sparking surface and the ground electrode sparking surface provide a spark gap. The center electrode body is constructed of a composite material including at least one ceramic material.

According to yet another aspect of the invention, a method of constructing a spark plug is provided. The method includes forming a ceramic material to form a generally annular ceramic insulator; forming a conductive shell configured to surround at least a portion of the ceramic insulator; providing a ground electrode operatively attached to the shell; forming a center electrode from a composite material including at least one ceramic material, and disposing the insulator and the center electrode in the shell.

BRIEF DESCRIPTION OF THE DRAWINGS

These and other aspects, features and advantages of composite ceramic electrode and spark plug constructed in accordance with the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
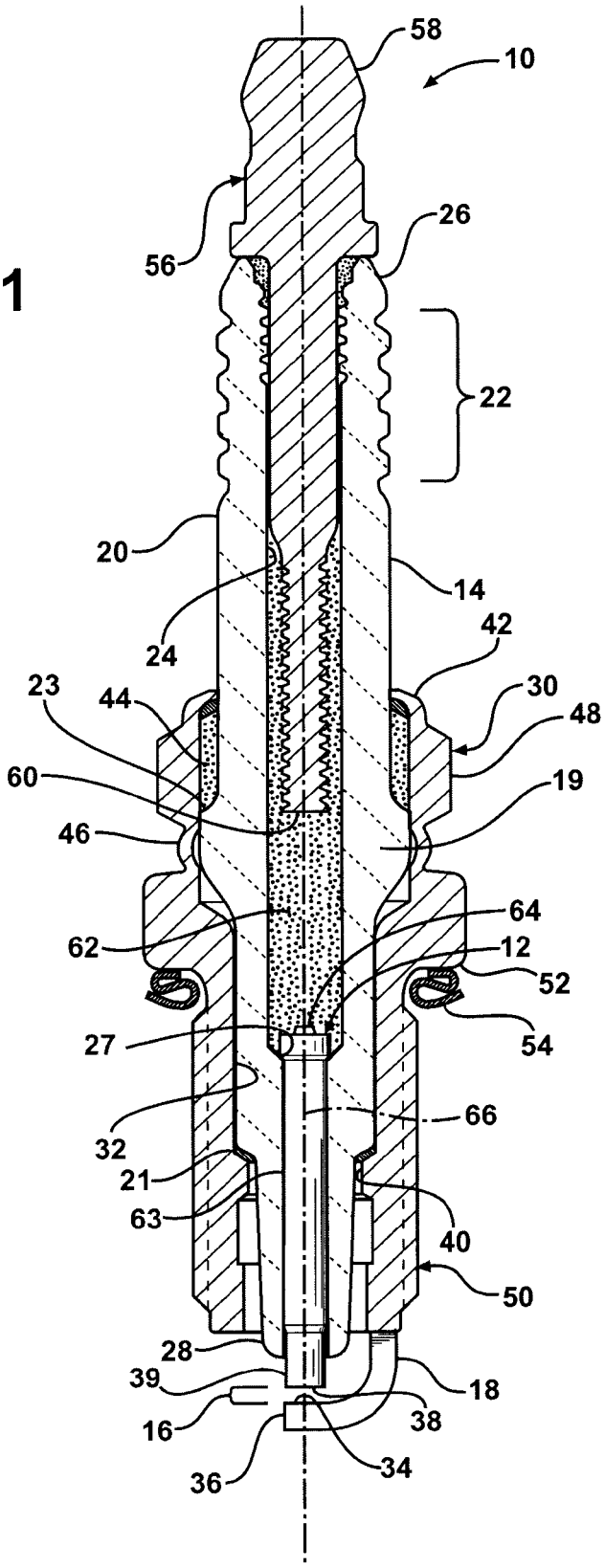
FIG. 1 is a cross-sectional view of a spark plug constructed in accordance with one presently preferred aspect of the invention.

Referring in more detail to the drawings, FIG. 1 illustrates a spark ignition device, referred to hereafter as spark plug, generally at 10 used for igniting a fuel/air mixture within an internal combustion engine (not shown). The spark plug 10 has a center electrode 12 constructed of a composite ceramic/ceramic material or a composite ceramic/metal material in accordance with the invention. The materials used for the center electrode 12 are capable of withstanding the most extreme temperature, pressure, chemical corrosion and physical erosion conditions experienced by the spark plug 10. These conditions include exposure to numerous high temperature chemical reactant species associated with the combustion process which commonly promote oxidation, sulfidation and other high temperature corrosion processes, such as those attributed to calcium and phosphorus in the combustion products, as well as reaction of the plasma associated with the spark kernel and flame front which promote erosion of the spark surface of the electrode 12. The center electrode 12 substantially avoids cyclic thermo-mechanical stresses typically otherwise associated with a mismatch in the thermal expansion coefficients of the common metal alloy electrode materials and associated components of the spark plug 10, such as an insulator 14, given the insulator 14 is also constructed from a ceramic material. Accordingly, the electrode 12 avoids high temperature creep deformation, cracking and fracture phenomena, which typically results in failure of electrodes. In addition, with the center electrode 12 being able to withstand or avoid the aforementioned conditions, a preset spark gap 16 between the center electrode 12 and a ground electrode 18 is able to be substantially maintained over the life of the vehicle. As such, the formation, location, shape, duration and other characteristics of the spark generated across the spark gap 16 is able to be optimized over the useful life of the spark plug 10. In turn, the combustion characteristics of the fuel/air mixture and performance characteristics of the engine in which the spark plug 10 is incorporated is able to be optimized.

The spark plug 10 includes the generally annular ceramic insulator 14, which may include aluminum oxide or another suitable electrically insulating material having a specified dielectric strength, high mechanical strength, high thermal conductivity, and excellent resistance to thermal shock. The insulator 14 may be press molded from a ceramic powder in a green state and then sintered at a high temperature sufficient to densify and sinter the ceramic powder. The insulator 14 has an outer surface which may include a lower portion indicated generally at 19 having a small lower shoulder 21 and a large upper shoulder 23, with a partially exposed upper mast portion 20 extending upwardly from the upper shoulder 23 to which a rubber or other insulating spark plug boot (not shown) surrounds and grips to electrically isolate an electrical connection with an ignition wire and system (not shown). The exposed mast portion 20 may include a series of ribs 22 or other surface glazing or features to provide added protection against spark or secondary voltage flash-over and to improve the gripping action of the mast portion 20 with the spark plug boot. The insulator 14 is of generally tubular or annular construction, including a central passage 24 extending longitudinally between an upper terminal end 26 and a lower core nose end 28. With respect to the embodiment of FIG. 1, the central passage 24 has a varying cross-sectional area, generally greatest at or adjacent the terminal end 26 and smallest at or adjacent the core nose end 28, with a transition shoulder 27 therebetween, although other passage configurations are possible and contemplated to be within accordance of the invention.

The spark plug includes an electrically conductive metal shell 30. The metal shell 30 may be made from any suitable metal, including various coated and uncoated steel alloys. The shell 30 has a generally annular interior surface 32 which surrounds and is adapted for sealing engagement with the outer surface of the lower portion 19 of the insulator 14 and has the ground electrode 18 attached thereto which is maintained at ground potential. While the ground electrode 18 is depicted in a commonly used single L-shaped style, it will be appreciated that multiple ground electrodes of straight, bent, annular, trochoidal and other configurations can be substituted depending upon the intended application for the spark plug 10, including two, three and four ground electrode configurations, and those where the electrodes are joined together by annular rings and other structures used to achieve particular sparking surface configurations. The ground electrode 18 has one or more ground electrode firing or sparking surface 34, on a sparking end 36 proximate to and partially bounding the spark gap 16 located between the ground electrode 18 and the center electrode 12, which also has an associated center electrode sparking surface 38 on a sparking end 39. The spark gap 16 may constitute an end gap, side gap or surface gap, or combinations thereof, depending on the relative orientation of the electrodes and their respective sparking ends and surfaces. The ground electrode sparking surface 34 and the center electrode sparking surface 38 may each have any suitable cross-sectional shape, including flat, arcuate, tapered, pointed, faceted, round, rectangular, square and other shapes, and the shapes of these sparking surfaces may be different. The center electrode 12 may have any suitable cross-sectional size or shape, including circular, square, rectangular, or otherwise or size. Further, the sparking end 36 may have any suitable shape. It may have a reduced cross-sectional size, and may have a cross-sectional shape that is different than the other portions of the center electrode.

The shell 30 is generally tubular or annular in its body section and includes an internal lower compression flange 40 configured to bear in pressing contact against the small mating lower shoulder 21 of the insulator 14 and an upper compression flange 42 that is crimped or formed over during the assembly operation to bear on the large upper shoulder 23 of the insulator 14 via an intermediate packing material 44. The shell 30 may also include an annular deformable region 46 which is designed and configured to collapse axially and radially outwardly in response to heating of the deformable zone 46 and associated application of an overwhelming axial compressive force during or subsequent to the deformation of the upper compression flange 42 in order to hold the shell 30 in a fixed axial position with respect to the insulator 14 and form a gas tight radial seal between the insulator 14 and the shell 30. Gaskets, cement, or other packing or sealing compounds can also be interposed between the insulator 14 and the shell 30 to perfect a gas-tight seal and to improve the structural integrity of assembled spark plug 10.

The shell 30 may be provided with an external tool receiving hexagon 48 or other feature for removal and installation of the spark plug in a combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. A threaded section 50 is formed on the lower portion of the shell 30, immediately below a sealing seat 52. The sealing seat 52 may be paired with a gasket 54 to provide a suitable interface against which the spark plug 10 seats and provides a hot gas seal of the space between the outer surface of the shell 30 and the threaded bore in the combustion chamber opening. Alternately, the sealing seat 52 may be configured as a tapered seat located along the lower portion of the shell 30 to provide a close tolerance and a self-sealing installation in a cylinder head which is also designed with a mating taper for this style of spark plug seat.

An electrically conductive terminal stud 56 is partially disposed in the central passage 24 of the insulator 14 and extends longitudinally from an exposed top post 58 to a bottom end 60 embedded partway down the central passage 24. The top post 58 is configured for connection to an ignition wire (not shown) which is typically received in an electrically isolating boot as described herein and receives timed discharges of high voltage electricity required to fire the spark plug 10 by generating a spark across the spark gap 16.

The bottom end 60 of the terminal stud 56 is embedded within a conductive glass seal 62. The conductive glass seal 62 functions to seal the bottom end 60 of terminal stud 56 and the central passage 24 from combustion gas leakage and to establish an electrical connection between the terminal stud 56 and the center electrode 12. Many other configurations of glass and other seals are well-known and may also be used in accordance with the invention. In addition, although not believed necessary in lieu of the construction of the center electrode 12, a resistor layer (not shown), as is known, made from any suitable composition known to reduce electromagnetic interference ("EMI"), could be disposed between the bottom end 60 of the terminal stud 56 and an upper end or head 64 of the center electrode 12. Accordingly, an electrical charge from the ignition system travels through the bottom end 60 of the terminal stud 56, through the glass seal 62, and through the center electrode 12.

Figure 2:
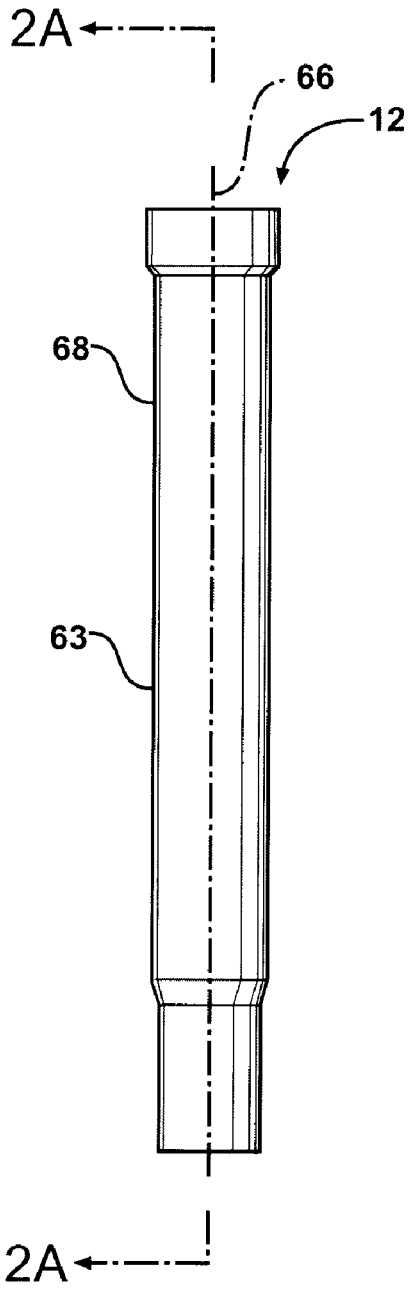
FIG. 2 is an enlarged side view of an electrode constructed in accordance with one presently preferred aspect of the invention.
Figure 2A:
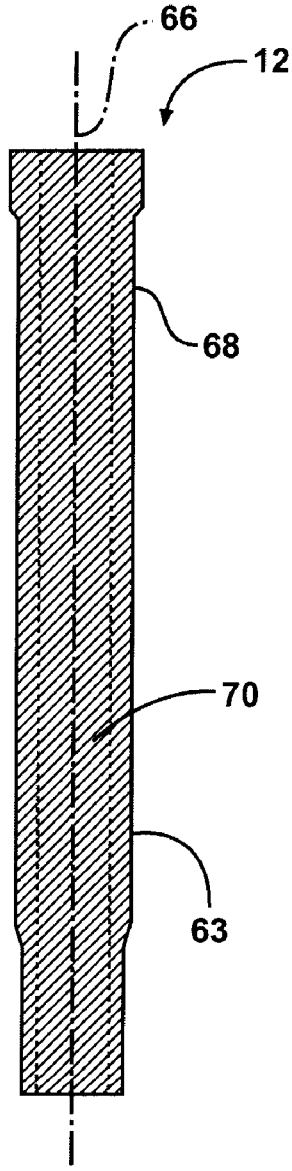
FIG. 2A is a cross-sectional view of the electrode of FIG. 2.

The center electrode 12 is partially disposed in the central passage 24 of the insulator 14 and has an elongate body 63, that extends along a longitudinal axis 66 from its enlarged radially outwardly flared head 64, which is encased in the glass seal 62, to its sparking end 38 which projects outwardly from the nose end 28 of the insulator 14 proximate, but spaced from, the sparking surface 34 of the ground electrode 18. The body 63 of the center electrode 12 is formed as a solid, one-piece, monolithic conductive or semi-conductive composite ceramic structure extending continuously and uninterrupted between its head 64 and its sparking end 38. The composite ceramic structure may be fabricated having at least two different composite materials, and can either be a ceramic-ceramic composition, or a ceramic-metal (CERMET) composition, depending on the specific attributes sought in the specific spark plug application. If constructed as a ceramic-ceramic composite, one exemplary composite structure example includes a composite of silicon nitride ($Si_3N_4$) and molybdenum disilicide ($MoSi_2$). As shown schematically in FIG. 2A, the concentration of the composition varies across the width of the body, in a cross-section taken generally perpendicular to the axis 66. Accordingly, the body 63 has a non-uniform concentration of the different ceramic materials as viewed along a cross-section taken generally perpendicular to the axis 66. The difference in composition across the width provides the electrode 12 with an insulating peripheral outer portion 68 and a conductive inner core portion 70 surrounded and encapsulated along the length of the electrode by the outer portion 68. It should be recognized that to allow direct electrical communication with and through the conductive inner core portion 70, that the core portion 70, although encapsulated by the outer portion 68 along the length of the electrode 12, is exposed at the opposite ends.

Figure 3A:
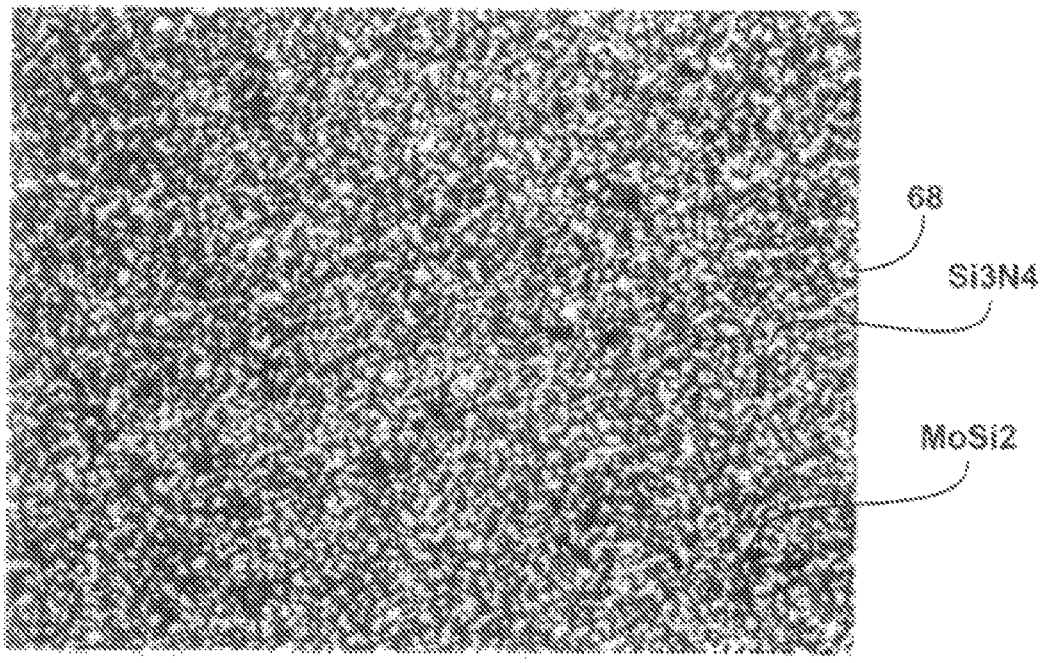
FIG. 3A illustrates a microstructure of one portion of the electrode.
Figure 3B:
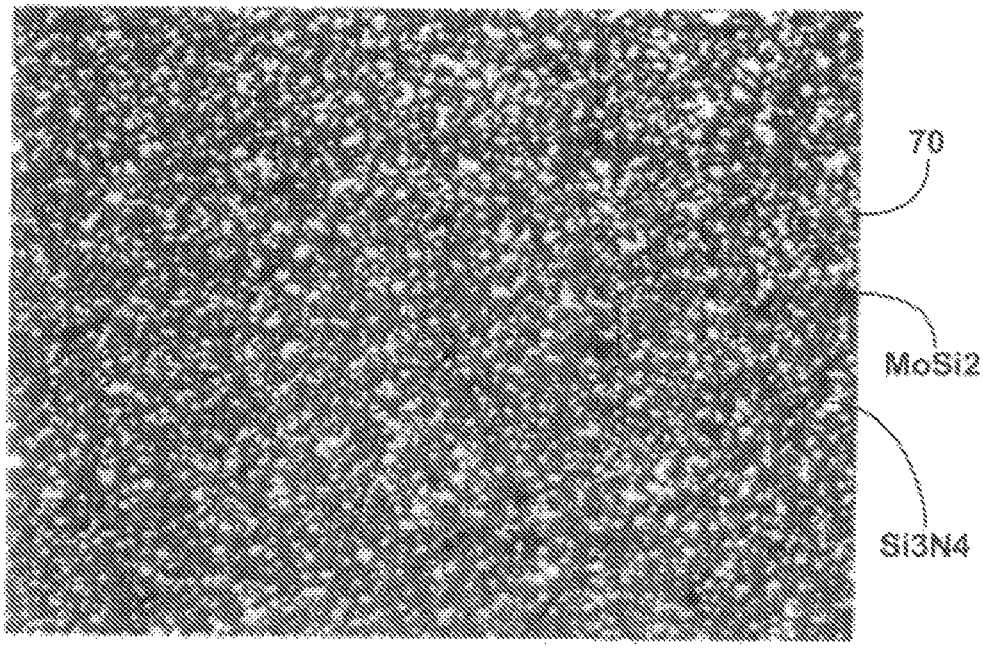
FIG. 3B illustrates a microstructure of another portion of the electrode.

In one exemplary embodiment, without limitation, the composition of the outer portion 68 can be provided having about 28 percent $MoSi_2$ and about 72 percent $Si_3N_4$ (microscopically illustrated in FIG. 3A), and the composition of the core portion 70 can be provided having about 43 percent $MoSi_2$ and about 57 percent $Si_3N_4$ (microscopically illustrated in FIG. 3B). Accordingly, the core 70 provides a conductive inner region extending along the entire length of the electrode 12 and the outer portion 68 provides an insulating region extending along the entire length of the electrode 12. It should be recognized that the aforementioned composite materials are by way of example, and that other materials could be used. For example, the insulating ceramic composite material could be provided as aluminum oxide, aluminum nitride, aluminum oxy-nitride, or silicon aluminum oxynitride, while the conductive ceramic material could be provided as titanium nitride or, titanium diboride. Otherwise, if the electrode 12 is to be provided as a ceramic-metal (cermet) composition, the conductive composite material could be provided as a metal, such as platinum, iridium, nickel or an alloy of nickel, for example. As previously mentioned, the percent concentration of the each of the insulating and conductive ceramic composite materials can be varied across the width of the electrode 12 and/or along the length of the electrode 12, depending on the performance requirements desired for the electrode 12. Accordingly, the level of resistance of the electrode 12 can be varied and located precisely at any location along the electrode to suppress RF noise, and the insulating and conductive properties of the outer portion 68 and core portion 70 can be provided as desired. This ability to vary the location of the resistance of the electrode 12 allows the increased resistance to be more closey positioned adjacent the spark gap 16, thereby optimizing the ability to suppress RF noise.

Figure 4:
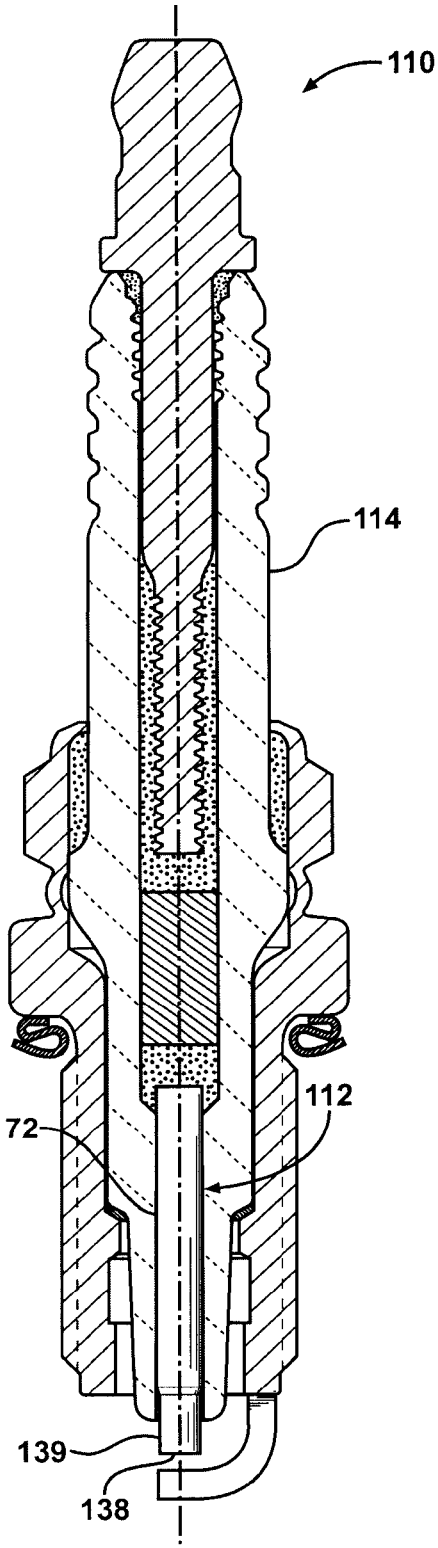
FIG. 4 is a cross-sectional view of a spark plug constructed in accordance with another presently preferred aspect of the invention.
Figure 5:
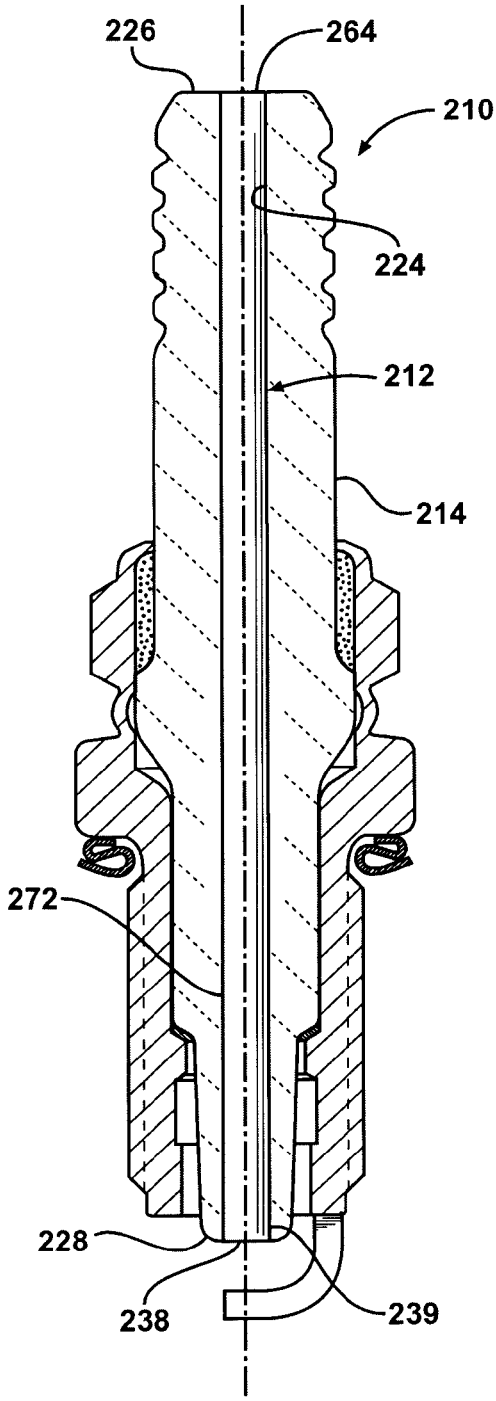
FIG. 5 is a cross-sectional view of a spark plug constructed in accordance with yet another presently preferred aspect of the invention.

While the center electrode 12 is illustrated in FIG. 1 having a headed pin configuration due to the flared upper end or head 64, the invention also encompasses all manner of headed arrangements with the head at the opposite end of the electrode (i.e., proximate the sparking end 36). In addition, as illustrated in FIG. 4, by way of example and without limitation, wherein reference numerals offset by a factor of 100 are used to identify similar features as described above, an electrode 112 of a spark plug 110 can be constructed as straight cylindrical configuration, thereby being well suited to be formed in an extruding process and co-fired or sintered along with an insulator 114 to permanently bond the electrode 112 to the insulator ceramic material via an as sintered bond represented generally at 72. Accordingly, the insulator 114 and electrode 112 can be constructed as a unitary subassembly that is economical in manufacture. In addition, as illustrated in FIG. 5, wherein reference numerals offset by a factor of 200 are used to identify similar features as described above, an electrode 212 of a spark plug 210 can be constructed as a straight cylindrical configuration having an outer surface with a constant or substantially constant diameter extending over a length sufficient to extend through the entire length of a central passage 224 within an insulator 214 of the spark plug. Accordingly, the central passage 224 of the insulator 214 can be formed as a cylindrical though passage of a constant or substantially constant diameter, and sized for close, pressing receipt of the electrode 212, wherein opposite upper and sparking ends 264, 239 of the electrode 212 are flush or substantially flush with the opposite terminal and nose ends 226, 228, respectively, of the insulator 214. Accordingly, the spark plug 210 does not have the conventional central resistor layer and glass sealing, as the electrode 212 extends completely through the passage 224 and performs the desired electrical resistance, depending on the composition of the ceramic material used to construct the electrode 212. Further, as with the electrode 112, the electrode 212 can be co-fired or sintered with the insulator 214 to permanently bond the electrode 212 to the insulator ceramic material via an as sintered bond represented generally at 272. Accordingly, the insulator 214 and electrode 212 can be constructed as a unitary subassembly that is economical in manufacture. It should be recognized that as well as those configurations illustrated, that the diameter of the electrode can be constructed to vary along its length, either in a stepwise, tapered or other manner, as desired. The center electrode 12, 112, 212, may have any suitable cross-sectional size or shape, including circular, square, rectangular, or otherwise or size. Further, the sparking end 39, 139, 239 may have any suitable shape. It may have a reduced cross-sectional size, and may have a cross-sectional shape that is different than the other portions of the center electrode. The sparking surface 38, 138, 238 may be any suitable shape, including flat, curved, tapered, pointed, faceted or otherwise.

The center electrode 12 of the invention may be formed using any suitable method for making ceramic articles of the types described, including injection molding and sintering, extrusion and sintering or pressing and sintering. In addition, given the center electrode 12 can be a ceramic-ceramic composite structure, it can be sintered or fired together with the insulator 14 in manufacture. This allows the center electrode 12 to be permanently positioned and bonded within the insulator 14, if desired.

Obviously, many modifications and variations of the present invention are possible in light of the above teachings. It is, therefore, to be understood that within the scope of the appended claims, the invention may be practiced otherwise than as specifically described.

What is claimed is:

1. A center electrode for a spark ignition device, said center electrode comprising:

an elongate body having a width and a length extending along a longitudinal axis, said body being constructed of a composite material including at least one ceramic material and a conductive material, wherein said body has a non-uniform concentration of said ceramic and conductive materials across the width of said body.

2. The center electrode of claim 1 wherein said conductive material is a second ceramic material.

3. The center electrode of claim 2 wherein said body has a peripheral outer portion and an inner core portion surrounded by said peripheral outer portion, said peripheral outer portion being constructed of a higher concentration of said first ceramic material and said core being constructed of a higher concentration of said second ceramic material, said first ceramic material being less conductive than said second ceramic material.

4. The center electrode of claim 3 wherein said inner core portion is exposed at opposite ends of said body in order to allow direct electrical communication during spark ignition.

5. The center electrode of claim 3 wherein said first ceramic material is provided from at least one of the group consisting of: aluminum oxide, aluminum nitride, aluminum oxy-nitride, silicon nitride, and silicon aluminum oxynitride.

6. The center electrode of claim 5 wherein said second ceramic material is provided from at least one of the group consisting of: titanium nitride, molybdenum disilicide and titanium diboride.

7. The center electrode of claim 1 wherein said conductive material includes a metal material.

8. The center electrode of claim 7 wherein said body has a composite peripheral outer portion and a composite inner core portion surrounded by said composite peripheral outer portion, said composite peripheral outer portion being constructed of a higher concentration of said at least one ceramic material and said core being constructed of a higher concentration of said metal material.

9. The center electrode of claim 8 wherein said at least one ceramic material is provided from at least one of the group consisting of: as aluminum oxide, aluminum nitride, aluminum oxy-nitride, silicon nitride, and silicon aluminum oxynitride.

10. The center electrode of claim 9 wherein said metal material is provided from at least one of the group consisting of: platinum, iridium, nickel and nickel alloy.

11. The center electrode of claim 1 wherein said at least one ceramic material is silicon nitride and said conductive material is molybdenum disilicide.

* * * * *